United States Patent [19]

Sato

[11] 4,213,389

[45] Jul. 22, 1980

[54] INK SUPPLY DEVICE FOR HAND LABELER

[75] Inventor: Yo Sato, Tokyo, Japan

[73] Assignee: Kabushiki Kaisha Sato Kenkyusho, Tokyo, Japan

[21] Appl. No.: 830,806

[22] Filed: Sep. 6, 1977

[30] Foreign Application Priority Data

Sep. 6, 1976 [JP] Japan ..... 51-105836
Dec. 11, 1976 [JP] Japan ..... 51-148314

[51] Int. Cl.[2] ..... B41K 1/42; B41K 5/00; B41F 1/40

[52] U.S. Cl. ..... 101/295; 101/324; 101/288; 101/305; 101/310; 101/348; 101/359; 24/265 B; 24/230 AL

[58] Field of Search ..... 101/288, 291, 348, 292, 101/310, 324, 326, 301, 359, 295, 327, 305; 24/265 B, 230 AL; 156/384

[56] References Cited

U.S. PATENT DOCUMENTS

| | | | |
|---|---|---|---|
| 1,724,074 | 8/1929 | DuBelle | 101/327 |
| 2,830,351 | 4/1958 | Harding et al. | 24/265 B |
| 3,329,018 | 4/1968 | Fientzel et al. | 24/230 AL |
| 3,686,055 | 8/1972 | Hermann | 156/384 |
| 3,704,492 | 12/1972 | Meredith, Sr. | 24/230 AL |
| 3,705,833 | 12/1972 | Wada | 101/292 |
| 3,712,173 | 1/1973 | Savioli et al. | 24/265 B |
| 3,762,317 | 10/1973 | Hamisch, Sr. | 101/288 |
| 3,902,952 | 9/1975 | Penaluna | 101/324 |
| 4,044,677 | 8/1977 | Hamisch, Jr. | 101/348 |

FOREIGN PATENT DOCUMENTS 3460444 6/1976 Fed. Rep. of Germany ..... 156/384

*Primary Examiner*—William Pieprz
*Attorney, Agent, or Firm*—Ostrolenk, Faber, Gerb & Soffen

[57] ABSTRACT

An ink supply device for inking the types of a hand labeler device, usually including at least two inking rollers which are rotatable over the type surfaces of a printing head; these ink rollers are removably held in an ink roller assembly which is, in turn, removably held in a movable holder; guide grooves in the side walls of the hand labeler frame guide the ink rollers over the type surfaces; roller cartridge frames are attached removably to the ink roller assembly for holding the ink rollers; retaining projections formed on at least one of the cartridge frames retain it in the holder and the projections act as knobs for attachment and removal of the corresponding cartridge frame, thus facilitating replacement of the ink rollers.

In a second embodiment, the ink roller assembly includes one or more roller holders for rotatably holding the ink rollers; a pair of elastically biased knobs are removably attached to the roller holder, and each is formed with a retaining pin; a support member of the assembly is attached to the link mechanism of the hand labeler for removably holding the ink roller assembly; the support member includes retaining holes for receiving the retaining pins; actuating members which elastically bias the support member.

12 Claims, 17 Drawing Figures

INK SUPPLY DEVICE FOR HAND LABELER

BACKGROUND OF THE INVENTION

1. Field of the Invention

The present invention relates to an ink supply device for use with a label printing and applying machine, usually of the portable type (hereinafter referred to as a "hand labeler").

2. Description of the Prior Art

In a hand labeler or a tag printing and applying machine, the printing types have been conventionally inked using a plurality of ink rollers which are impregnated with ink of the same or different colors. For example, U.S. Pat. No. Re. 27,889, of the inventor hereof, entitled "Portable One-Hand-Operable Labeling Machine" describes a dichromic inking process. Two printing heads are fixed to yokes which are swung up and down together by the actuation of a hand lever. There are two separated rotating arms, which respectively hold the two ink rollers. Each roller is impregnated with a different color ink. The rollers are independent and rotatable, with one roller in front of the printing heads and the other behind the printing heads. The separate roller supporting arms are pivotally mounted in the machine frame of the hand labeler. Each arm is urged by a respective spring against the respective type surface of the printing head.

Squeezing of the hand lever lowers the yokes, and with them the front and rear printing heads. This pushes aside the front and rear ink rollers and their respective spring biased rotating arms. The front ink roller inks the type surface of the front printing head, whereas the rear ink roller inks the type surface of the rear printing head. When the hand lever is further squeezed, it lowers the yokes until the type surfaces of the respective printing heads contact and print a label.

The rotating arm that supports the rear ink roller is placed so as to pivot substantially at the center of the inside of the machine frame of the hand labeler. This enlarges the size of the hand labeler. Further, attachment and removal of the rear roller supporting arm becomes so difficult as to defeat the usefulness of the labeler when it comes to replacement of the rear ink roller.

In U.S. Pat. No. 3,902,952, entitled "Hand Operated Labeler", there is a holder, in which two ink rollers impregnated with different color inks are rotatably mounted. The rollers are attached to a front portion of the hand labeler by a holder. The ink rollers are urged against the type surfaces by the action of a spring. The attachment and removal of the ink roller holder is facilitated.

However, both of the above systems have disadvantages. Since the ink rollers are brought into contact with the type surfaces only by the biasing force of the spring, the pressure of the ink rollers against the type surfaces becomes weaker as the biasing force of the spring weakens due to aging. The quality of the ink imprints deteriorates. Further, as the ink rollers are progressively less deeply depressed by the type surfaces, the ink is not pumped to the surfaces of the ink rollers. Only a small part of the available stored ink is usable. As a result, the ink rollers can be used for a limited number of labels only, thus rendering the reviewed hand labelers uneconomical.

If the hand lever is squeezed too swiftly, the ink rollers may be kept away from any contact with the type surfaces or may only have very weak contact. As a result, no imprint is obtained on the label or color shading difference occur across an imprint.

In U.S. application Ser. No. 772,469, filed Feb. 28, 1977, of the inventor hereof, entitled "Ink Supply Mechanism for Dichromic Portable Labeling Machine", now U.S. Pat. No. 4,095,524 two different color ink rollers are provided and they use an effective forced ink-oozing system. However, attachment of new ink rollers and removal of exhausted ink rollers remains quite difficult. In this system, there is a pair of ink roller holding members, which are independently swingable and which are equipped with guide rollers. The holding members are fitted in retaining grooves at both sides of a front ink roller frame, which is attached to an ink roller assembly.

With the arrangement of this application, it is difficult to replace the ink rollers. In part, this is because the two holding members cannot be made integral. Even if a bridge member connecting the holding members into an integral structure is provided, the bridge member would collide with the front ink roller. Moreover, because the guide rollers are attached to the rear ink roller frame, it is difficult to preset only the guide rollers in the rear guide grooves, to then attach the ink roller assembly to the holding members and to subsequently attach the rear ink roller frame to that assembly.

Since the front and rear frame holders constituting the ink roller assembly are pivotally pinned so as to rotate relative to each other, it becomes more difficult to attach them to the rotatable holding members.

Other inking devices are disclosed in U.S. application Ser. No. 716,934, filed Aug. 23, 1976, now abandoned and replaced by continuation application Ser. No. 3,626 filed Jan. 15, 1979 and particularly devices which are easier to remove and attach. But, these devices also have some of the problems discussed above.

SUMMARY OF THE INVENTION

It is an object of the present invention to provide an ink supply device for use with an inexpensive, easily operated hand labeler.

It is another object to provide such an ink supply device which is usable for two color printing on a small volume or scale.

Another object of the present invention is to provide an ink supply device which can be easily inserted and removed.

It is another object of the present invention to enable simplified removal and attachment by the fingers of an operator of the ink supply device to a support member attached to the link mechanism of the hand labeler.

A further object of the present invention is to provide such an ink supply device of the above type, in which the pressures that the ink rollers exert upon the type surfaces of the front and rear printing heads, respectively, are regulated to a constant proper level.

Yet another object of the present invention is to provide an ink supply device for use with a hand labeler, in which the large space normally occupied in conventional systems by the front and rear rotating arms and by the ink rollers is minimized by holding the paired ink rollers in the form of an integral assembly, thereby to reduce the size and weight of the hand labeler as a whole to such an extent as to allow easy handling, even by a female operator having relatively small hands.

Another object of the present invention is to attach the ink roller assembly to the support member so as to free the assembly from breakage while the assembly is swinging.

Still another object of the present invention is to attach two ink rollers independently of each other and to elastically urge them against the type surfaces of a three-stage or other wide type surface printing device.

The invention concerns an ink supply device for use with a hand labeler. The device comprises: at least two ink rollers impregnated with ink and adapted to be rolled over the type surfaces of a printing head so as to apply ink to them. There is an ink roller assembly for removably holding the ink rollers in place. There is a holder that is adapted to removably hold the ink roller assembly and to be moved to enable the ink rollers to ink the type surfaces. Guide means are formed in the side walls of the hand labeler for guiding the motion of the ink rollers in contact with the type surfaces of the printing head.

There are at least two cartridge frames removably attached to the ink roller assembly for holding the ink rollers so that they can rotate. There are retaining means for being retained in the holder for the assembly and for acting as knobs to effect the attachment and removal of said at least one of the cartridge frames. In one embodiment, the retaining means are formed in at least one of the cartridge frames. In another embodiment, the retaining means are separate from but attached to the cartridge frames.

In one embodiment, there is a box-shaped ink roller assembly comprised of a front ink roller that is held in an integral box-shaped holder through a rotatable positioning holder and a rear ink roller that is held in the box-shaped holder. This holder can be inserted in the hand labeler with ease. The holder is retained by the retaining means, a pair of biased knobs, which are operated to facilitate the replacement of the ink rollers.

In the first embodiment, swingable attaching members are attached to the holder and are upwardly biased so that the front guide rollers of the holder are located on an imaginary attaching line joining the attaching shafts of the rotating arm and the holder and the center of the rear guide rollers of the holder. This also facilitates attachment and removal of the ink roller assembly to and from the holder.

In the second embodiment, the ink roller assembly includes a roller holder for holding the ink rollers for rotation. A pair of knobs is elastically biased apart so as to be removably attachable to the roller holder. A respective retaining pin is formed on each knob. A support member group is attached to the link mechanism of the hand labeler for removably holding said ink roller assembly; the support member group includes a support member that is formed with a pair of retaining holes for retaining the retaining pins and a pair of actuating members for elastically biasing the support member to a type surface inking position.

BRIEF DESCRIPTION OF THE DRAWINGS

Other objects and features of the present invention are now described with reference to the accompanying drawings, in which.

DESCRIPTION OF THE PREFERRED EMBODIMENT

A first embodiment of the present invention is now described.

Figure 1:
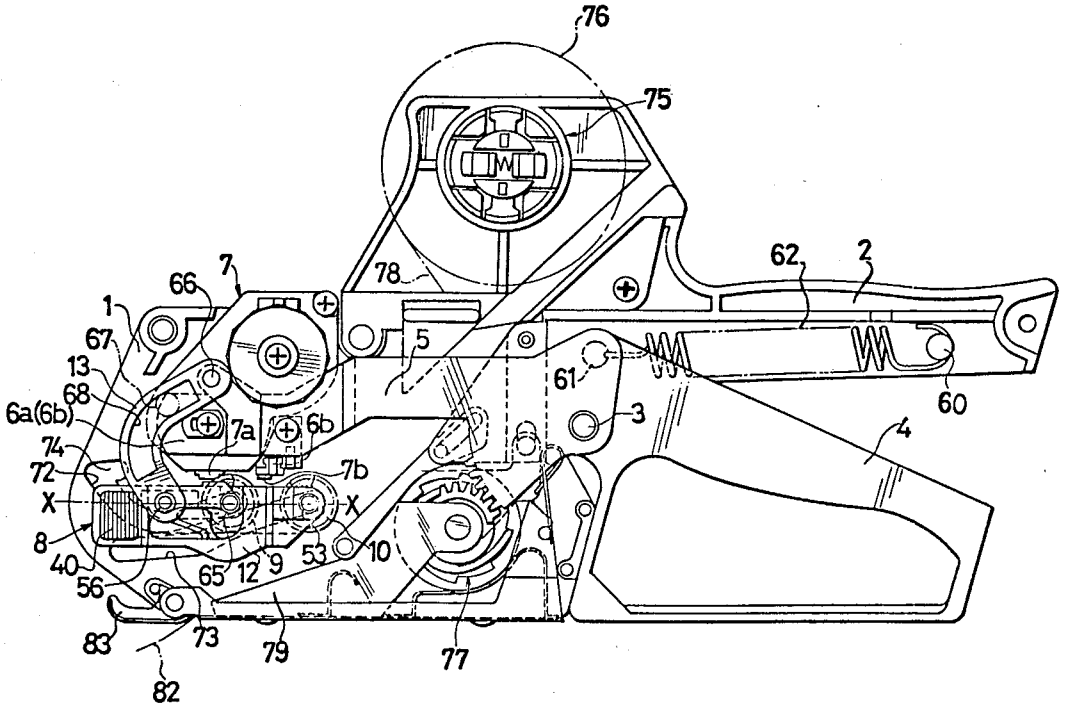
FIG. 1 is a side elevational view showing a hand labeler, which is equipped with an ink supply device according to a first embodiment of the present invention, wherein the machine frame on the near side has been removed.
Figure 2:
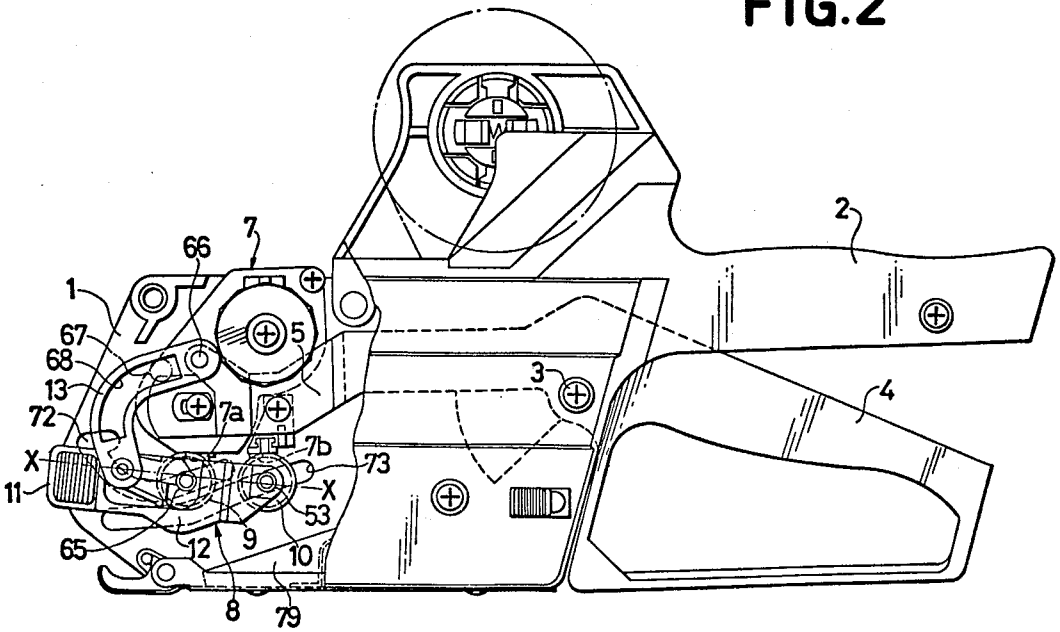
FIG. 2 is the same type of view as FIG. 1, in which the ink rollers are in contact with the type surfaces as a result of the actuation of the hand lever.

FIG. 1 shows a hand labeler which is equipped with an ink supply device 8. The hand labeler comprises machine side frames 1 having an integral grip 2 extending from the rear side (or right-hand side in FIG. 1). A pivot shaft 3 extends between the machine frames 1 nearer their rear side. A hand lever 4 is pivotally supported on the shaft 3. The front portion of the lever 4 is formed into a pair of spaced apart yokes 5. A printing device 7 is fixed at the leading or front (left) ends of the yokes 5. The device 7 carries two printing heads 6*a* and 6*b*, wherein the former is located forwardly of the latter.

There is a spring pin 60 toward the rear of the grip 2. A spring hole 61 is formed toward the front end of the hand lever 4. An actuating spring 62 is interposed under tension between the hold 61 and the spring pin 60 so that the yokes 5 and the hand lever 4 are continuously biased to turn clockwise about the pivot shaft 3.

Figures 6A, 6B, 6C, 6D:
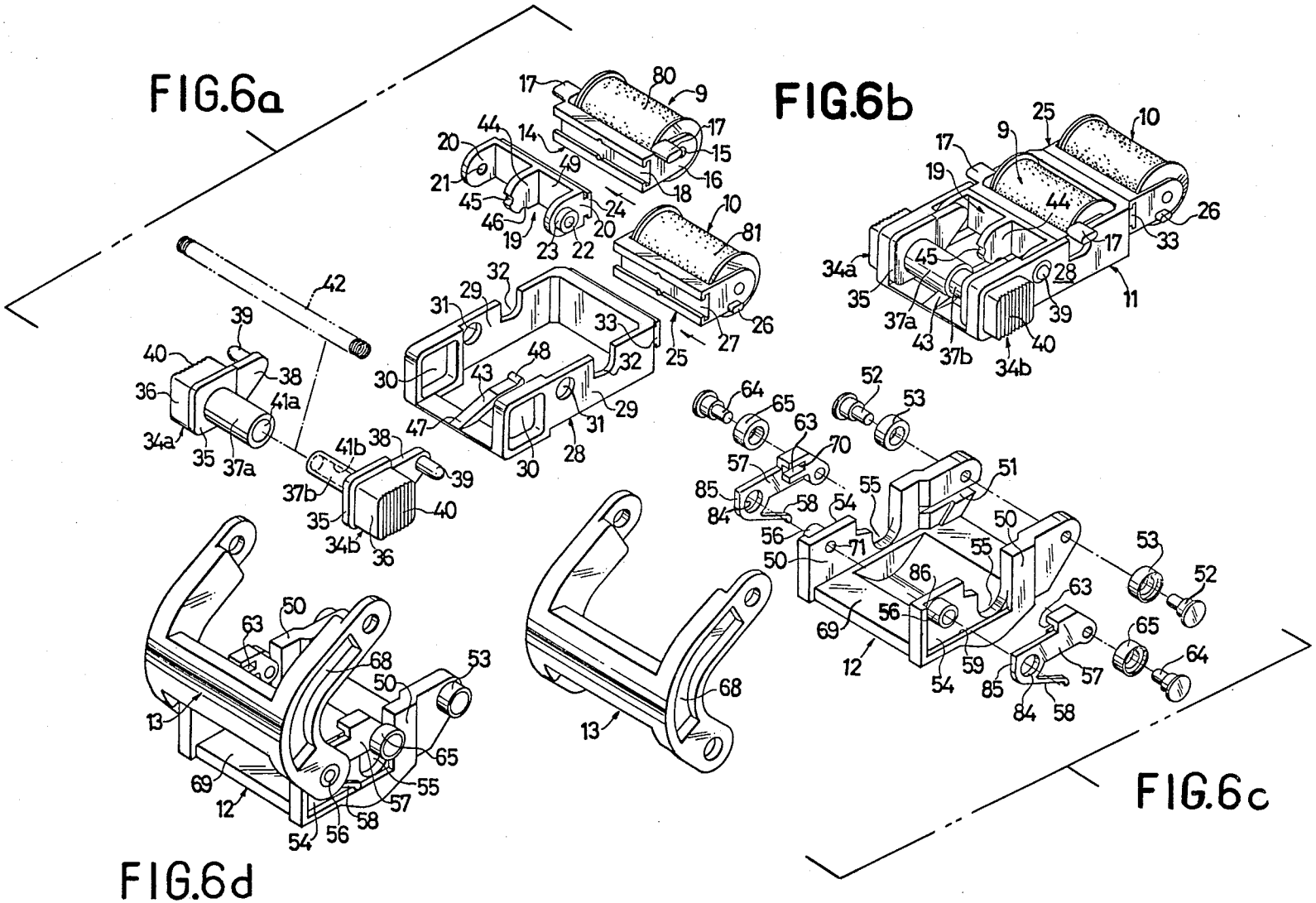
FIG. 6A is an exploded perspective view of an ink roller assembly according to the first embodiment of the invention.
FIG. 6B is an assembled perspective view of the ink roller assembly.
FIG. 6C is an exploded perspective view of the holder for the ink roller assembly.
FIG. 6D is an assembled perspective view of the holder.
Figure 7:
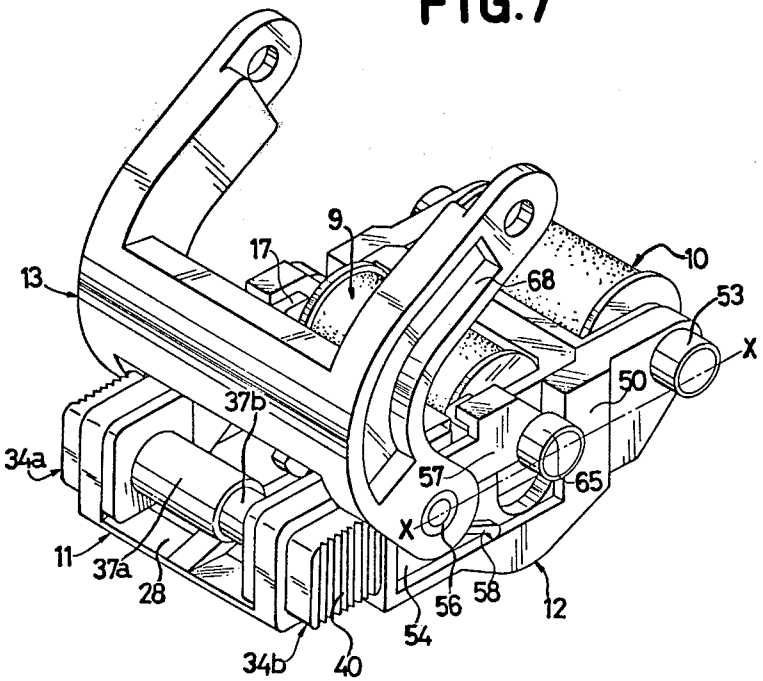
FIG. 7 is a perspective view showing the ink roller assembly of the ink supply device attached to its holder.
Figure 8:
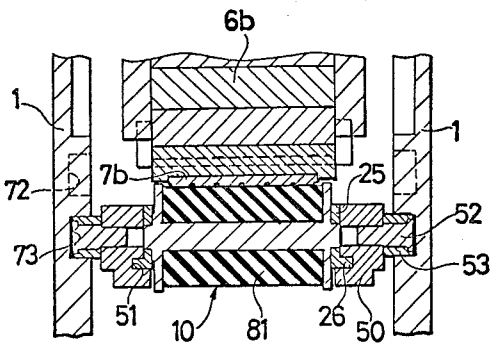
FIG. 8A is a longitudinal cross-sectional, elevational view of the front ink roller, showing it while it is supplying ink to the front type surface.
FIG. 8B is a longitudinal cross-sectional elevational view of the rear ink roller, showing it while it is supplying ink to the rear type surface.
Figure 8:
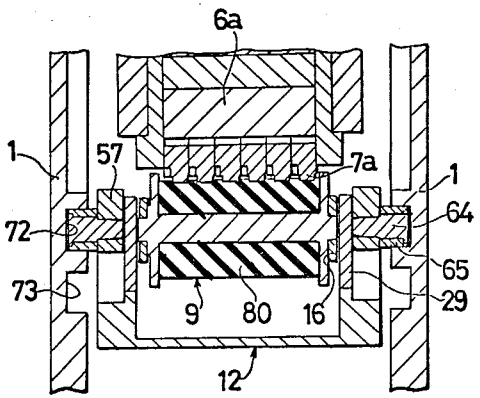

Referring to FIGS. 6 and 7, the ink supply device 8 of the first embodiment of the invention is comprised of an ink roller assembly 11 for holding two ink rollers 9 and 10, a holder 12, to which the ink roller assembly 11 is removably attached, attaching members 57 and a rotatable arm 13.

The ink rollers 9 and 10 are equipped, respectively, with ink impregnated bodies 80 and 81, which are respectively impregnated with different color inks, such as black and red.

As shown in FIG. 6, the front ink roller 9 of the ink roller assembly 11 has shaft ends 15 at both of its ends. The shaft ends 15 are fitted in holes formed in the leg portions 16 of a cartridge frame 14 such that they are rotatably attached to the cartridge frame 14. The cartridge frame 14 has a U-shaped cross-section including a pair of outwardly projecting attaching projections 17 at the upper ends of the leg portions 16. Frame 14 also has a C-shaped retaining portion 18 at the outer surface of its bridge portion.

There is a trifurcated or three legged holder 19, to which the cartridge frame 14 is removably attached. The outer leg portions 20 of the trifurcated holder 19 have holes 21 passing through them. A respective engaging ring 23 is attached integrally to each leg portion 20. Each ring 23 has a hole 22 therethrough which is registered with the hole 21 of the respective leg portion 20. The leg portions are spaced apart such that they may fit between the below described side walls 29 of body 28. At the rear (right hand) side of the bridge portion 49 of the trifurcated holder 19, an engaging projection 24 is formed. It is sized and shaped to slidingly engage into the C-shaped retaining portion 18 of the cartridge frame 14.

The center leg portion 44 of the trifurcated holder 19 is formed at its leading or forward end and at its lower end with engaging notches 45 and 46, respectively, of substantially semicircular shape.

The rear roller 10 is attached rotatably to a U-shaped cartridge frame 25 in the same manner as the front ink roller 9. This cartridge frame 25 has a pair of attaching projections 26 at the lower ends of its leg portions and has a C-shaped retaining portion 27 at the outer front surface of its bridge portion.

There is a box-shaped assembly body 28, to which the holder 19 and the cartridge frame 25 are attached. The assembly body 28 has opposite side walls 29. Along each side wall 29, moving rearwardly from the front (or the left-hand side) of FIG. 6, there are a rectangular hole 30, a round hole 31 and an open top notch 32. The rear surface of the rear wall of the assembly body 28 supports an engaging projection 33, which is engageable with the forwardly facing C-shaped retaining portion 27 of the cartridge frame 25.

There is a flexible member 43, which has its lower, forward end 47 fixed to the front end of the assembly body 28. Its other end projects generally upwardly and rearwardly and that end includes a positioning projection 48. The flexible member 43 has such flexibility that the positioning projection 48 rocks up and down about the fixed end 47.

There are a pair of opposite knobs **34*a* and 34*b*. Each knob is divided into an outside and an inside portion by a flange 35. The outside portion comprises the rectangular portion 36, while the inside portion is formed of opposed cylinder portions 37*a* and 37*b*, respectively. The cylinder portion 37*a* has a bore 41*a* into it with a larger diameter than the outer diameter of the other cylinder portion 37*b* such that the cylinder portion 37*b* can be fitted into the bore 41*a*. The cylinder portion 37*b* also has a bore 41*b*** into it.

The rearwardly extending portion 38 of each flange 35 has a retaining pin 39 formed on its outer surface and projecting therefrom. The outside surface of each rectangular portion 36 has a roughened non-slip surface 40.

The above-described members are assembled as now described to form the ink roller assembly 11. The holder 19 is placed so that the rings 23 pass into the round holes 31.

A coiled compression spring 42 is inserted into the bores **41*a* and 41*b* of the cylinder portions 37*a* and 37*b*. The smaller cylinder portion 37*b* is forced into the bore 41*a* of the larger cylinder portion 37*a* so that the knobs 34*a* and 34*b* may be squeezed to each other. As they are being squeezed together, the knobs 34*a* and 34*b* are placed between the side walls 29 of the assembly body 28. Then, the knobs 34*a* and 34*b* are released so that their rectangular portions 36 and their retaining pins 39 may be fitted into and biased into the rectangular holes 30 and the neighboring round holes 31 by the elastic force of the coil spring 42. Since the engaging rings 23 of the holder 19 have already been fitted in the round holes 31, the retaining pins 39 pass through the holes 21 of the holder 19 and through the holes 22 of the engaging rings 23 until the leading ends of the pins 39** protrude to the outside.

The holder 19 is next turned counterclockwise about the retaining pins 39 so that the bridge portion 49 is into an upper position and so that the engaging notch 45 at the front end of the center leg portion 44 may be brought into engagement with the positioning projection 48 of the flexible member 43. This fixes the holder 19 in the up position. The C-shaped retaining portion 18 of the cartridge frame 14, to which the front ink roller 9 has been attached, is slid sideways onto the engaging projection 24 of the bridge portion 49 of the holder 19 and the roller 9 and holder 19 thereafter constitute an integral structure. Then, the C-shaped retaining portion 27 of the cartridge frame 25, to which the rear ink roller 10 is attached, is also slid sideways into engagement with the engaging projection 33 at the rear end of the assembly body 28, thus finishing the assembly of the ink roller assembly 11.

After the cartridge frame 14 has been attached to the holder 19, the temporary assembly comprised of the front ink roller 9, its holder 19 and the cartridge frame 14 is turned clockwise to be held substantially horizontal in the assembly body 28. This brings the engaging notch 46 at the lower end of the center leg portion of the holder 19 into engagement with the positioning projection 48 of the flexible member 43 and holds that temporary assembly in the horizontal position. The front ink roller 9 should not be prevented from rotating as a result of its contacting the bottom of the assembly body 28. For this purpose, there is a sizable space between the underside of the positioning projection 48 and the bottom of the assembly body 28.

The holder 12 is now described. It is generally U-shaped with upstanding opposed side walls 50. The rear interior portions of walls 50 are curved inwardly and define a pair of horizontal attaching grooves 51 above their protruding inner sides. Moreover, a pair of guide 53 are rotatably attached to the rear ends at the outer sides of the side walls 50 by the attaching shafts 52. The axes of the guide rollers 53 are aligned with the axes of the rear ink roller 10.

At the front outer surfaces of the side walls 50 there are rectangular recesses 54. The rear ends of the recesses 54 terminate in notches 55, which open upwardly. The upper front portions of the recesses 54 have engaging through holes 71 located there, and annular pivot shafts 56 are attached to the side walls 50 coaxially with the holes 71.

The attaching members 57 are pivotally supported on the shafts 56 through the pivot holes 84 at the front ends of the members 57.

Below the holes 84 on the attaching members 57 there are integrally attached slender elastic members 58. The rearwardly and downwardly extending ends of the members 58 abut against the bottom surfaces 59 of the recesses 54, and this biases the attaching members 57 to rotate counterclockwise. The front or left hand ends of the attaching members 57 have regulating surfaces 85 which are moved into abutting engagement with regulating surfaces 86 that are formed on the back side of the front wall of the holder 12, thereby ensuring the aforementioned horizontal positioning of member 57. The rear portions of the attaching members 57 including horizontally widened, vertically spaced apart, inwardly protruding plates that are so thickened as to define attaching grooves 63 which extend horizontally between the inwardly protruding plates. These plates extend inwardly past notches 55.

To the outer rear ends of the attaching members 57 a pair of guide rollers 65 are rotatably attached by the shafts 64. The center of each shaft 64 is normally positioned to be on the attaching line X—X that joins the center of the respective pivot shaft 56 for the holder 12 and the rotating arm 13 and the center of the respective guide roller 53. Moreover, the centers of the guide rollers 65 are in alignment with the center of the ink roller 9.

As shown in FIG. 1, the rotating arm 13 has its upper end portions swingably attached to the leading or forward end portions of the yokes 5 and has its lower ends swingably attached to the shafts 56 at the front portions of the holder 12. Both side portions of the rotating arm 13 include a respective guide groove 68 extending along its length. A pair of guide pins 67 fixed to the inner walls of the machine frames 1 are fitted in the pair of guide grooves 68, such that the guide pins 67 may slide in the grooves 68.

Then, the ink roller assembly 11 is attached to the holder 12, which has been swingably attached to the rotating arm 13, in accordance with an assembly procedure described below.

Figure 5:
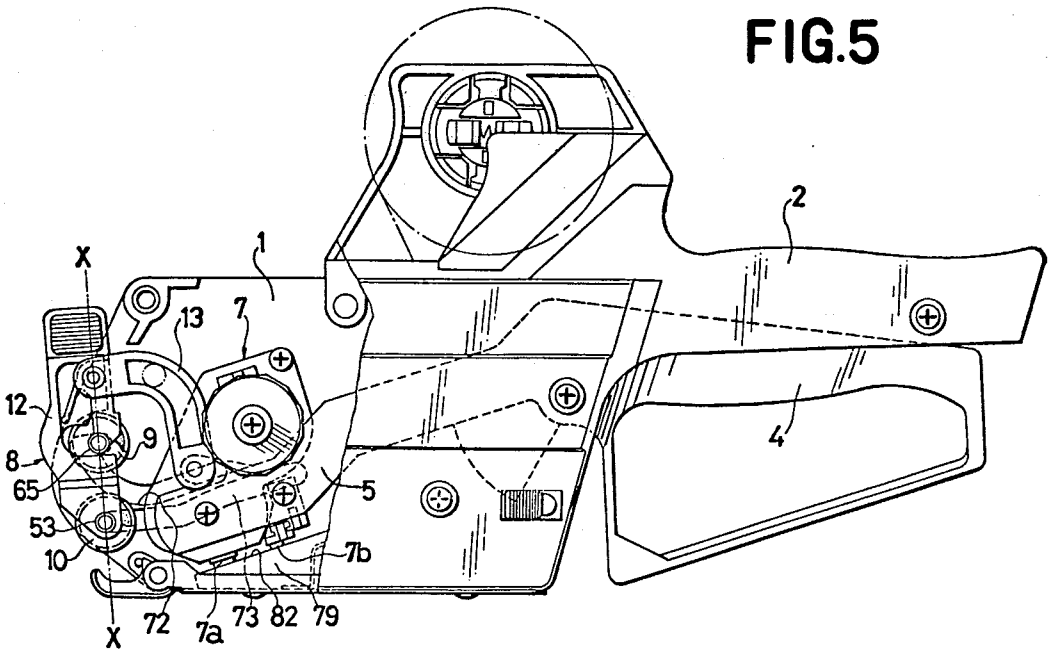
FIG. 5 is also the same type of view, showing the hand lever fully squeezed and the ink roller assembly in position to permit attachment and removal of the ink roller assembly.

First, the grip 2 and the hand lever 4 are fully squeezed together, as shown in FIG. 5, until the holder 12 assumes the upright position and partially protrudes from the front end of the machine frames 1. In this instance, the center of each guide roller 65 of an attaching member 57 is located on the attaching line X—X. Also, both of the grooves 63 of the attaching members 57 and the grooves 51 of the holder 12 are oriented to be parallel to the attaching line X—X.

In the next step, the rough surfaces 40 of the knobs **34*a* and 34*b* of the assembly 11 are squeezed between the fingers of the operator, as seen in FIG. 6, and the knobs 34*a* and 34*b* approach each other while compressing the coil spring 42. When the spring is released upon release of the rough surfaces 40 of the knobs 34*a* and 34*b*, the retaining pins 39 protrude outside the side walls 29 of the assembly body 28 and their leading ends are forced into the holes 22 until the insides of the side walls 29 are engaged by the extending portions 38. The assembly 11 under this condition is inserted through the upper open portion 69 of the holder 12 in FIG. 5 (or through the front open portion 69 in FIG. 6), with the rear ink roller 10 being directed downwardly in FIG. 5 (or rearwardly in FIG. 6**).

During this insertion, the attaching projections 26 of the cartridge frame 25 are fitted into the grooves 51, while the attaching projections 17 of the cartridge frame 14 are fitted into the grooves 63 of the attaching members 57. Access to the grooves 63 is through the large notches 55. The assembly 11 is then pushed downwardly with respect to the holder 12 in FIG. 5 (or rearwardly, as seen in FIG. 6) until the top (or rear) ends of the projections 17 abut against the stop surfaces 70 at the top (or rear) ends of the grooves 63.

Release of knobs **34*a* and 34*b* also permits the retaining pins 39, which are integral with the knobs, to protrude outside the side walls 29 and to extend into the holes 71 of the holder 12. The holes 71 are positioned so that the ink roller assembly 11 and the holder 12 may be retained and combined to ensure attachment of the ink rollers 9 and 10 to the holder 12**.

With reference to FIGS. 1–5 and FIGS. 8(A) and 8(B), the inner walls of the machine frames 1 have front or upper guide grooves 72 and rear or lower guide grooves 73. The guide grooves 72 and 73 are generally inclined downwardly and forwardly (or in the leftward direction in the drawings). The front end portions of the front guide grooves 72 are inclined upwardly and forwardly. Their upper ends have rearwardly directed return portions 74. On the other hand, the rear guide grooves 73 have front end portions that are oriented substantially horizontally.

The front guide grooves receive the guide rollers 65 that are attached to the attaching members 57, while the rear guide grooves 73 receive the guide rollers 53 that are attached to the holder 12. Thus, as the ink supply device 8 moves back and forth, the respective guide rollers 65 and 53 can turn in the guide grooves 72 and 73.

In FIG. 1 there is a label holder 75 which holds a roll of a continuous label strip 76 in a rotatable manner. A label feed mechanism 77 (see U.S. application Ser. No. 716,934, filed Aug. 23, 1976, for example) feeds a continuous strip of labels 78 from the label roll 76 onto a platen 79.

The operation of this embodiment of the ink supply device according to the present invention is now described. The grip 2 and the hand lever 4 are squeezed together from their condition of FIG. 1 and the hand lever 4 is turned upward or counterclockwise. This pivots the yokes 5 counterclockwise or downward about the pivot shaft 3. The descent of the yokes pivots the rotating arm 13 clockwise and also upwardly about the shaft 66. While the rotating arm 13 is guided for rotation, its guide grooves 68 are engaged and regulated by the stationary guide pins 67, which project from the inner walls of the machine frames 1. As a result, the ink roller assembly 11 is moved forward as the rotating arm 13 pivots clockwise, because assembly 11 is attached to the holder 12, which, in turn, is pivotally attached to the rotating arm 13.

The guide rollers 53 of the holder 12 and the guide rollers 65 of the attaching members 57 are guided to move forward by the rear guide grooves 73 and by the front guide grooves 72, respectively. This permits the front and rear ink rollers 9 and 10 to turn while exerting a regulated constant pressure against the type surfaces *7a* and *7b* of the printing device 7.

Although the guide means for the guide rollers 65 and 53 is shown as the guide grooves 72 and 73, the guide means must not be so limited, but can comprise any of a variety of guide devices, such as guide rails.

Meanwhile, the center of the guide rollers 65 is located below the attaching line X—X. Since the front ink roller 9 is coaxial with the guide rollers 65, it is also located below the line X—X while it is applying a predetermined pressure to the type surface *7a*. The reason why the ink roller 9 (or the guide rollers 65) is positioned below the line X—X is that the type surface *7a* is moved further downward than the type surface *7b* from their respective positions of FIG. 1 because the distance between the pivot shaft 3 and the type surface *7a* is larger than the distance between the shaft 3 and the type surface *7b*. Moreover, one reason for the notches 55 and 32 is so that the front ink roller 9 can rotate downward about the shafts 56 (or 39).

With the foregoing arrangement, therefore, each of the ink rollers 9 and 10 can be positioned so as not to be too close or too far from the corresponding one of the type surfaces *7a* and *7b* and so that it can press the corresponding surface *7a* or *7b* under a preset suitable pressure at all times. Thus, the spongy, ink-impregnated bodies 80 and 81 of the ink rollers 9 and 10 may roll over the type surfaces *7a* and *7b*, while their surfaces are forcibly depressed by the type surfaces *7a* and *7b*. The ink stored in the center portions of the ink-impregnated roller bodies 80 and 81 is pumped to the outer surfaces of the respective ink rollers 9 and 10 when the depressions in the bodies 80 and 81 restore their original shapes. Thus, the application of ink to the type surfaces *7a* and *7b* can be performed sufficiently and uniformly.

Figure 3:
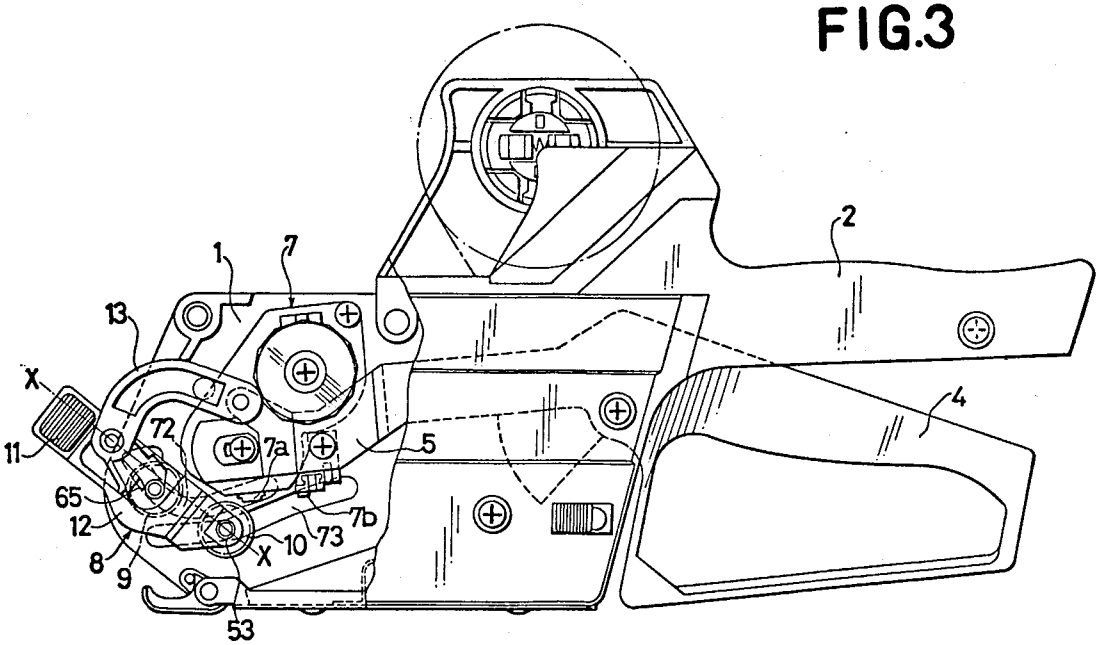
FIG. 3 is also the same type of view as FIG. 1 showing the condition of the labeler, in which the ink rollers have passed the type surfaces.

When the hand lever 4 is further squeezed, as shown in FIG. 3, the ink supply device 8 is moved forward to a position in front of the hand labeler, where the device 8 is inclined upwardly and to the front. In this instance, the center of the guide rollers 65 is still located before and below the attaching line X—X similarly to the condition of FIG. 2. During this position change, the guide rollers 53 for the rear ink roller 10 are moved below their original positions because they are guided to turn in the rear guide grooves 73, which are inclined downwardly and to the front. As a result, the rear ink roller 10 is kept away from contact with the type surface *7a* of the front printing head *6a*.

Figure 4:
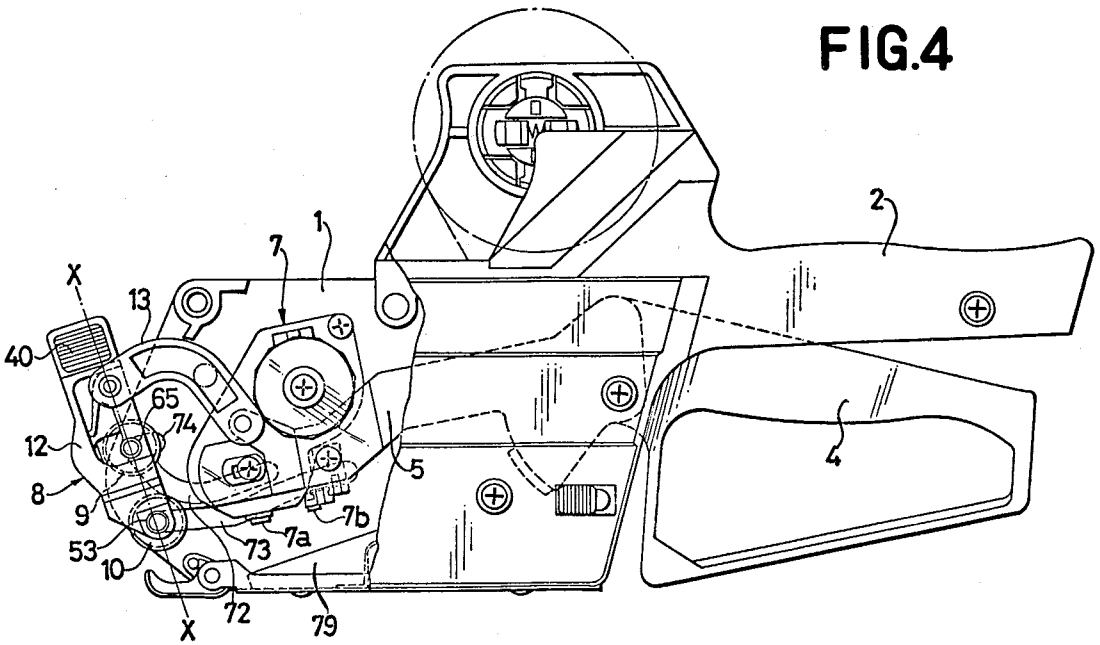
FIG. 4 is again the same type of view, showing the hand lever further actuated to shift the ink rollers forwardly.

When the hand lever 4 is further squeezed to the position shown in FIG. 4, the ink supply device 8 is moved both forward and upward until it takes a substantially upright position. Meanwhile, the center of the guide rollers 65 is shifted to be along the attaching line X—X, and the rear ink roller 10 arrives at the front end of the rear guide groove 73.

When the hand lever 4 is squeezed through its full stroke, as shown in FIG. 5, the yokes 5 are moved further downward and the guide rollers 65, which have already reached the upper ends of the front guide grooves 72, are twisted to enter their rearward return portions 74. Meanwhile, the center of the guide rollers 65 are still located on the attaching line X—X.

As has already been described, the attaching and detaching of the ink roller assembly 11 are accomplished while the hand lever 4 is being gripped to its full stroke, as shown in FIG. 5. It is not until that condition is attained that the surfaces 40 of the knobs 34a and 34b are caused to protrude to the outside of the machine frames 1 so that they become ready to be manually held.

In case the ink supply in either of the ink rollers 9 or 10 has been consumed, the paired knobs 34a and 34b of the ink roller assembly 11 are held by their roughened surfaces 40 and are pulled upward along the attaching line X—X by the fingers of the operator. Then, the retaining rods 39 are retracted inside the side walls 29 together with their knobs 34a and 34b. This frees the attaching projections 17 and 26 to now be slid along the line X—X within the attaching grooves 63 and 51, thus rendering the ink roller assembly 11 ready for removal from the holder 12.

To replace the front ink roller 9, its attaching projections 17 are manually held and moved to turn the temporary assembly of the ink roller 9, the cartridge frame 14 and the holder 19 to an upright position. The positioning projection 48 of the flexible member 43 is brought into engagement with the front engaging notch 45 which is formed at the center leg 44 of the holder 19. After that, the cartridge frame 14 is slid sideways to disengage its C-shaped retaining portion 18 from the engaging projection 24 of the holder 19. Another cartridge frame 14, to which a fresh ink roller 9 has been attached, is slidingly emplaced on the holder 19.

To replace the rear ink roller 10, the cartridge frame 25 is slid sideways to remove it from the engaging projection 33 of the assembly body 28. Then, another cartridge frame 25, to which a fresh ink roller 10 is attached, is assembled to the assembly body 28.

The operation of the hand labeler is now described. When the hand lever 4 is squeezed, the ink supply device 8 as a whole is turned clockwise and out of the way, so that the type surfaces *7a* and *7b* of the printing device 7 may be brought into contact with a label 82, which is separated from the continuous label strip 78 and is placed on the platen 79. This effects the desired printing.

When the hand lever 4 is released from its squeezed condition, the yokes 5 are returned upward in the clockwise direction by the compression of the stretched actuating spring 62. This returns the rotating arm 13 in the direction opposite to that along which the arm moved during the squeezing. This rolls the guide rollers 65 and 53 along the guide grooves 72 and 73. Meanwhile, the ink roller assembly 11 is retracted rightwardly in the drawings and it applies ink to the type surfaces *7a* and *7b* as it passes through the conditions of FIGS. 4, 3 and 2 in this order, and into its original condition of FIG. 1.

During the returning operations, the label feed mechanism 77 feeds the continuous strip of labels 78. At the same time, the printed label 82 is separated from its backing paper and is fed below an applicator 83.

The present invention is not limited to an ink supply device of the dichromic type. It can be applied to such an ink supply device, which is equipped with a plurality of ink rollers that are all impregnated with the same color ink. The present invention could also be applied to an ink supply device having a single ink roller.

Figure 9:
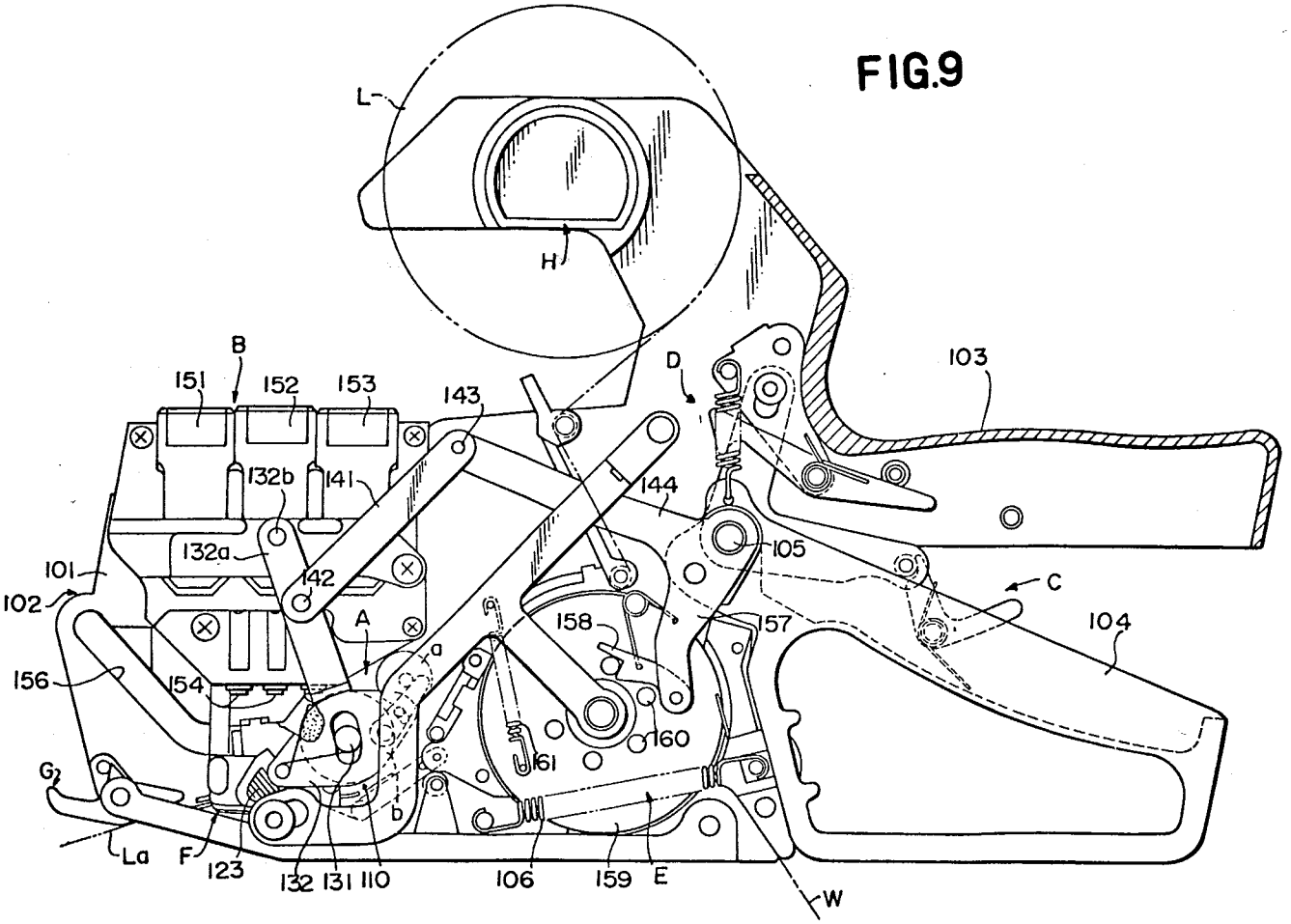
FIG. 9 is a partially cut-away, side elvational view of a hand labeler showing an attaching mechanism for an ink roller assembly according to a second embodiment of the present invention, with the frame plate on the near side of the hand labeler being removed, and with the labeler in the stationary condition.
Figure 10:
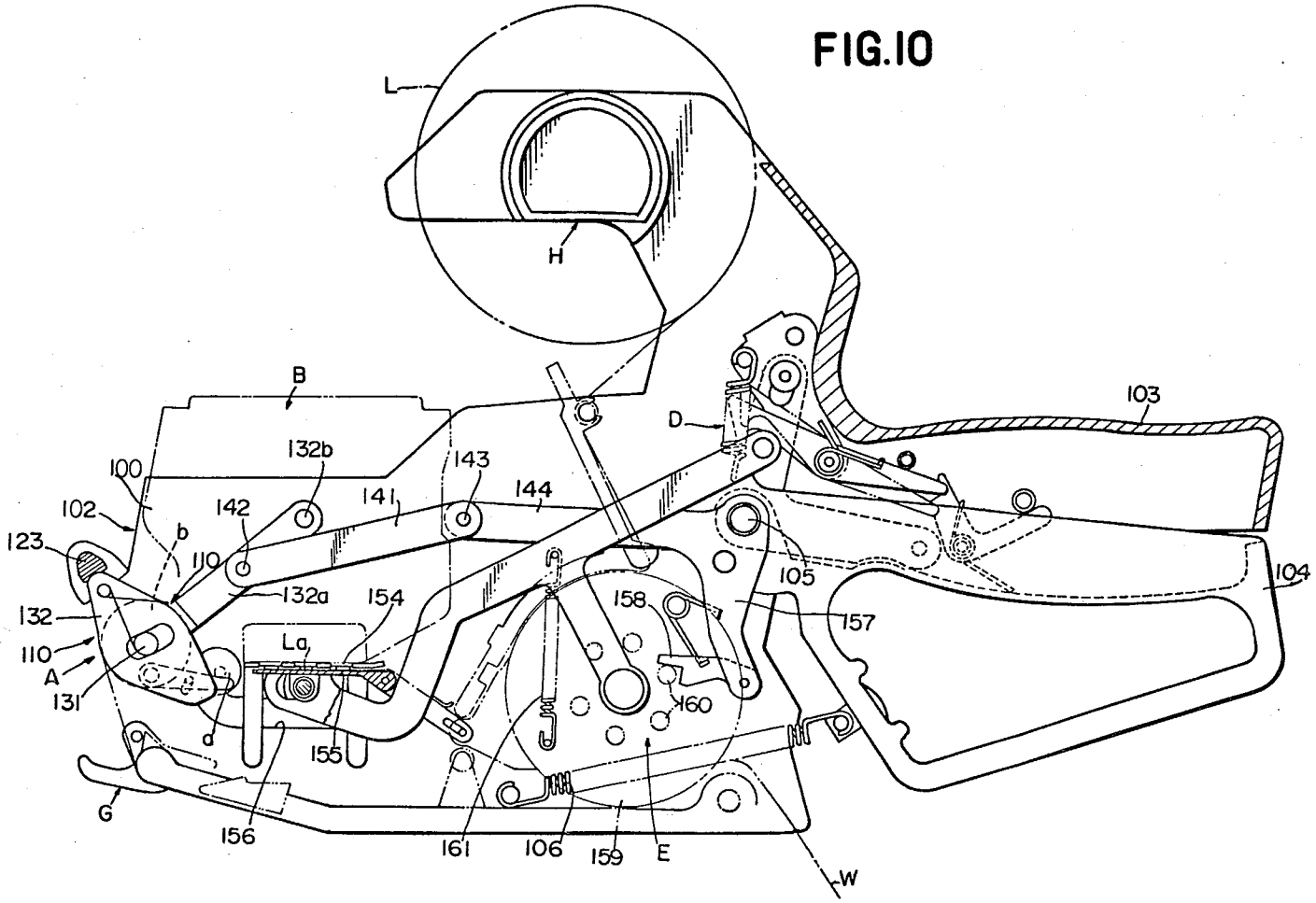
FIG. 10 is the same type of view as FIG. 9, with the hand labeler in the printing condition.

FIGS. 9 and 10 show a hand labeler, which is equipped with an ink roller assembly attaching and removing mechanism 110 according to the second embodiment of the invention. The opposed frame plates 101 of the hand labeler are spaced apart and their front, center rear and lower portions are joined by a number of the shafts of the labeler, thus constituting a complete machine frame 102.

The attaching and removing mechanism is mounted at a lower front portion of the machine frame 102. Also mounted there is an ink supply device A, which is moved up and down through a link mechanism and which acts together with a printing device B, as described hereinafter. The printing device B is located above the ink supply device. The printing device B has three stages and is comprised of three printing heads 151, 152 and 153. The printing device is fixed to the machine frame 102. Behind the printing device B, there is a drive mechanism C, which is comprised of a grip 103, a hand lever 104 and the associated conventional operating elements. At the center portion of the machine frame 102, there is a constant printing pressure mechanism D of the type, for example, shown in U.S. application Ser. No. 720,225, filed Sept. 2, 1976 now U.S. Pat. No. 4,057,452. The printing pressure mechanism is equipped with a platen 155 which is moved by the pressure mechanism to eventually hit the type surfaces 154 of the printing device B for printing a label on the platen. Mounted at a lower center portion of the machine frame 102, there is a label feed mechanism E, also of the type shown in U.S. application Ser. No. 720,225, now U.S. Pat. No. 4,057,452, which is intermittently rotated by the squeezing and releasing of the hand lever 104 through intermediate mechanisms so as to feed a continuous strip of labels L, one label La at a time. In the label strip L, the labels La are overlaid on and adhered to the common backing paper W by an adhesive.

At a position below and forward in the machine frame of the label feed mechanism E, there is a separating device F, which separates the individual labels La of the continuous label strip L from a tape of backing paper W by forming a loop of the backing paper in a narrow space forward of the platen. At a position below and forward of the separating device F, an applicator G is mounted to the frame 102. It applies each of the labels La to a commodity. Above the upper center portion of the machine frame 102, a label holder H is supported. It rotatably holds a roll of the continuous label strip L.

The attaching and removing mechanism 110 of the ink roller assembly 110A is mounted in the ink supply device A. It is comprised of the ink roller assembly 110A, shown in FIG. 11, and of a group of support members 110B, shown in FIG. 12, which are attached to the link mechanism of the hand labeler, thereby mounting the assembly 110A thereon.

Figure 11:
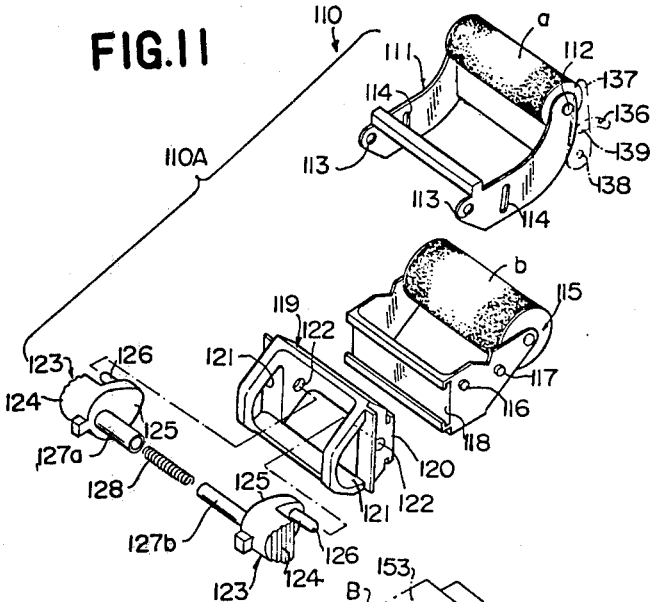
FIG. 11 is an exploded perspective view of the ink roller assembly according to the second embodiment of the present invention.

The ink roller assembly 110A in FIG. 11 is comprised of a small roller a, which is made of a spongy material and is impregnated with ink, a small roller holder 111, on which the small roller a is rotatably supported, a large roller b, which is made similarly to the smaller roller a, a large roller holder 115, on which the larger roller b is rotatably supported, an attaching holder 119, a pair of knobs 123, and a coil spring 128 placed between the knobs and biasing them apart.

The small roller holder 111 is comprises of a pair of side plates. The right hand ends of these plates (in the drawings) support the small roller a in a rotatable manner. A pair of roller shafts 12 project out from the side plates. At their left hand ends, the side plates have respective attaching holes 113 extending through them, and a short distance behind the holes 113, there are slots 114.

The large roller holder 115 also has a pair of side plates which support the large roller b at their right hand ends in a rotatable manner. At the outer surfaces of these side plates near their top and forward edges, there are a pair of support projections 116. Behind these projections, there are a pair of guide projections 117. The roller holder 115 is generally U-shaped and it is fitted into the open space inside the generally rectangularly shaped small roller holder 111. The paired support projections 116 are fitted into the attaching holes 113 of the small roller holder 111 and the paired guide projections 117 are inserted into the slots 114 of the small roller holder 111. The guide projections 117 are free to swing over the range defined by the slots 114 about the support projections 116.

Once the roller holders 111 and 115 have been assembled to form a unitary structure, their two ink rollers a and b are juxtaposed along the turning loci of the respective type surfaces 154 of the printing heads 151, 152 and 153. The large roller holder 115 has a C-shaped engaging groove 118 on the forwardly facing side of its bridge portion.

The attaching holder 119 is generally C-shaped with its rearwardly (rightward in the drawings) facing bridge portion carrying an engaging projection 120 which is sized and shaped to slidingly fit into the engaging groove 118 of the large roller holder 115. This removably attaches the holder 119 and the larger roller holder 115. Both arm portions of the attaching holder 119 have a respective one of a pair of substantially triangular through holes 121 formed in them and a respective one of a pair of round through holes 122.

Each of the pair of knobs 123 is to be assembled into the attaching holder 119. On its outer side, each knob has a substantially triangular push surface 124. The base 125 of one knob 123 carries a hollow cylinder **127*a* at the side facing toward the other knob. The base 125 of the other knob 123 carries a rod portion 127*b* which faces toward the first knob. A coil spring 128 is fitted into the cylinder 127*a*, followed by the rod portion 127*b*, and the paired knobs 124 are elastically biased apart. A pair of retaining pins 126 project out from the outwardly facing surfaces of the bases 125 of the knobs 123 just to the rear (to the right) of the push surfaces. The retaining pins 126 are fitted into the through holes 122 of the attaching holder 119, and the push surfaces 124 are fitted into the through holes 121 of the holder 119**.

Figure 12:
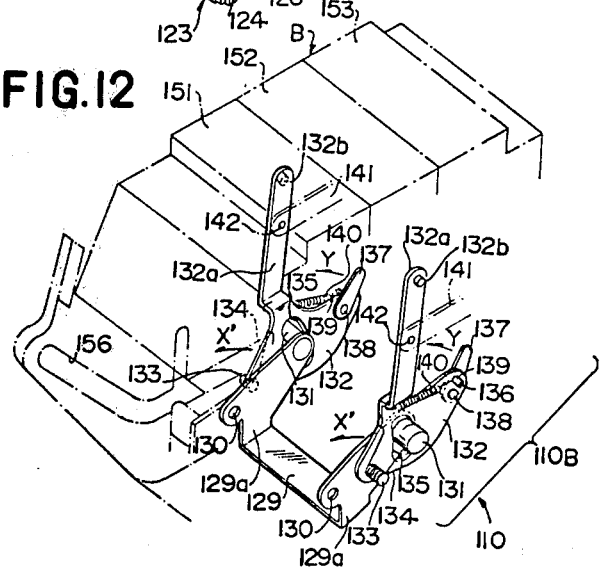
FIG. 12 is a perspective view showing a support member group, which is attached to the link mechanism of the hand labeler for removably holding the second embodiment of the ink roller assembly.

Referring to FIG. 12, the support member group 110B is comprised of a U-shaped support member 129, a pair of actuating members 132 and a pair of actuating levers 137. There is a link mechanism comprised of a link 141 and a drive lever 144 which coacts with the drive mechanism C, as shown in FIG. 9.

As shown in FIG. 12, the ink roller assembly 110A is mounted to and retained in the support member group 110B. Both opposed arm plates **129*a* of support member 129 are formed with retaining holes 130. The paired retaining pins 126 of the ink roller assembly 110A are elastically retained in holes 130 and are emplaced from the inside of plates 129*a*. Both arm plates 129*a* have a guide pin 131** which projects out from the top end thereof.

A pair of the attaching members 132 are attached to the outer sides of the support member 129. Each member 132 has a slot 135 therethrough that receives the respective guide pin 131 on the plate **129*a*. The support member 129 is biased upwardly in the direction of arrows X; by the elastic force exerted by springs 134 which are mounted on the pins 133 fixed to the outer sides of the actuating members 132**.

At the rearward ends of and on the inner sides of the paired actuating members 132, there is a pair of actuating levers 137 which are elastically biased upward, in the direction shown in arrows Y. The actuating levers 137 are pivotally supported on the support pins 138 on the inside of the actuating members 132. The levers 137 carry the guide pins 139 on their outsides and pins 139 are engageable with slots 136 formed in the actuating members 132. Coil springs 140 are interposed between the guide pins 139 and the arms 132*a* of the actuating members 132 so that the actuating levers 137 may be elastically biased upward about the support pins 138.

The guide pins 131 of the support member 129 protrude out through the slots 135 of the actuating members 132 until they engage the paired guide grooves 156, which are formed in the inner sides of the hand labeler frame plates 101. This engagement allows swinging motion of the whole mechanism. The guide grooves 156 are of a width slightly larger than the diameter of the guide pins 131 as to ensure operation of the support member 129 under the spring forces.

The operation of the second embodiment of the present invention is now described.

Figure 13:
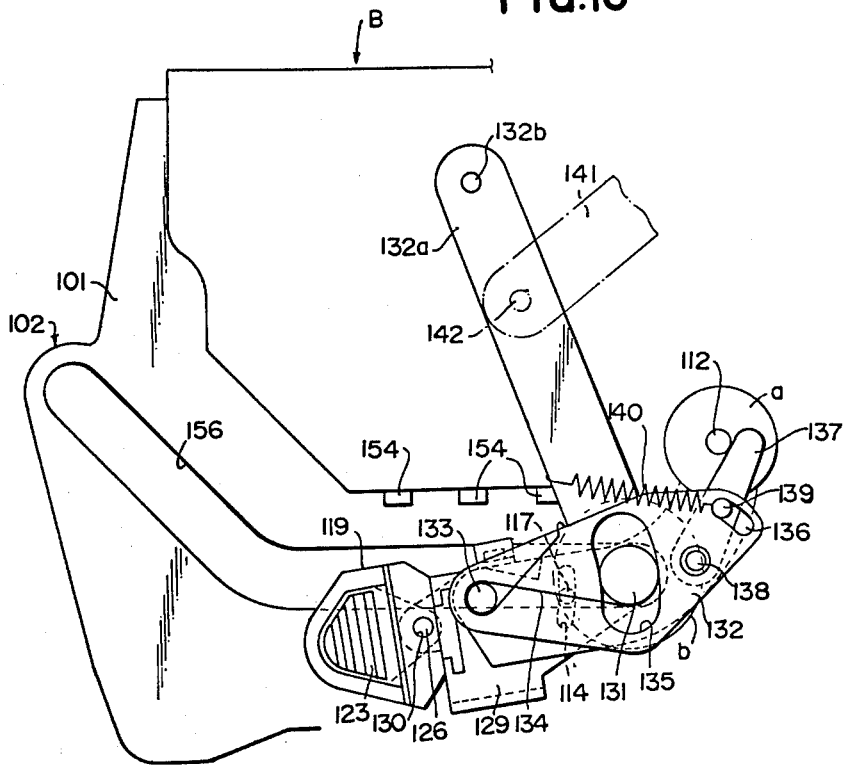
FIG. 13 is a side elevational view showing the second embodiment of the ink roller assembly fitted on the support member group.

To retain the ink roller assembly 110A in the support member group 110B of FIG. 12 and with the two ink rollers a and b shown in FIG. 11 being juxtaposed to each other, the outwardly biased paired knobs 123 are squeezed and are then inserted into the space between the support members 129. As shown in FIG. 13, the retaining pins 126 on the knobs 123 are brought into engagement with the paired retaining holes 130 of the support member 129. As shown in FIG. 13 and FIG. 11 (in chain lines), the roller shafts 112 of the small roller a are urged against the upper or left side of the actuating levers 137 against the action of the springs 140.

In the ink roller assembly 110A as a whole, therefore, the large and small rollers b and a are biased through the slots 135 and the guide pins 131 toward the type surfaces 154 of the printing device B by the action of the springs 134. The small roller a itself is further biased independently, through the engagement in the slots 114 of the guide projections 117, toward the type surfaces 154 by the action of the coil springs 140.

Ink supply by the above described mechanism is now reviewed. When the grip 103 and the hand lever 104 are squeezed, the various parts are shifted from the stationary condition of FIG. 9 to the condition of FIG. 10. The paired parallel drive levers 144 are swung downwardly about a fixedly located pivot shaft 105 on the frame 102. The paired links 141, which are connected to the drive levers 144 by the connecting pins 142, are swung downwardly and clockwise about the pivot pins 132*b* which are pivotally supported on and fixedly located in the frame plates 101.

The ink supply device A accomplishes the inking while the actuating members 132 are being pivoted clockwise and upwardly. The ink roller assembly 110A, which is retained in the support member group 110B, is moved forward as its guide pins 131 are guided in the guide grooves 156 formed in the frame plates 101. Meanwhile, the two ink rollers a and b of the ink roller assembly 110A are biased by the springs 134 and 140 so that ink is applied to the type surfaces 154 of the printing heads 151, 152 and 153. After inking, the assembly 110A moves to a position in front of the hand labeler, as shown in FIG. 10.

When the hand lever 104 is squeezed further, the constant printing pressure mechanism D operates the platen 155 under a preset pressure into abutment against the type surfaces 154. This prints the label La which is then on the platen 155. Then, the platen 155 is returned to the lowered position of FIG. 9 by the action of the return spring 161.

When the hand lever 104 is released, the ink supply device A moves from in front of the hand labeler back between the frame plates and across the type surfaces 154 until the ink supply device takes the position of FIG. 9. During this return motion the continuous label strip L is advanced the length of one label, while the backing paper W is moved rearwardly by the action of the label feed mechanism E. Mechanism E is comprised of a branch lever 157 extending down from the drive lever 144, a hook 158, a rotatable drum 159 and feed pins 160 on the side of drum 159.

Removal of the ink roller assembly 110A is required when the printing on the labels La become dim after the ink in either of the two ink rollers a and b has been consumed. The ink roller assembly 110A is removed as a whole from the support member group 110B. The paired knobs 123 of the ink roller assembly A are squeezed together until the retaining pins 126 are disengaged from the retaining holes 130 of the support members 129, thus allowing the removal of the assembly A from the support member group B.

Then, the attaching holder 119 is slidingly separated from the larger roller holder 115. The two ink rollers a and b are discarded together with their respective holders 111 and 115. Fresh roller holders 111 and 115 having ink rollers a and b that are impregnated sufficiently with ink, are fitted to the attaching holder 119, thus reassembling the ink roller assembly 110A. Then, the assembly 110A is attached to the support member group 110B.

The attachment and the removal of the ink roller assembly 110A is accomplished under the printing condition of FIG. 10 while the support member group 110B of the ink supply device A is positioned in front of the hand labeler.

The following advantages can be obtained with the present invention.

The assembly holding the ink rollers can be attached and removed with ease. Similarly, the ink rollers themselves can be attached and removed. As a result, the replacement of the ink rollers can be accomplished remarkably simply and rapidly.

Because the attachment and removal of the ink roller assembly is accomplished through manually squeezable knobs, this prevents the fingers of the operator from being stained with ink.

The ink-impregnated ink rollers contact the type surfaces under a regulated constant pressure at all times. Thus, the quantity of ink to be applied to the type surfaces can be regulated to a constant level, thus ensuring highly precise printing of labels with desired uniform shading.

Ink at the surfaces of the ink-impregnated rollers and also ink at the centers of these rollers can be consumed without substantial waste. This increases the number of labels that can be printed by each set of the ink rollers before the ink supply is exhausted, thus rendering a hand labeler using the present ink supply invention highly economical.

Moreover, the roller holders for the small and large ink rollers are independently biased toward the type surfaces of the printing device, and the two ink rollers are juxtaposed next to each other along the turning loci on the type surfaces. Thus, the ink can be uniformly applied with high precision. This is especially valuable for a hand labeler having a printing device which includes at least three printing heads.

Because the paired ink rollers are held in an integrated assembly, the space required for an inking device can be reduced in comparison with conventional inking devices, thus reducing the bulk of the hand labeler.

Even if the hand lever is squeezed and released at high speed, the resultant ink shading differences in the imprints on the labels can be maintained at a minimum level.

With the foregoing features in mind, a hand labeler equipped with an ink supply device according to the present invention can be used to print in a dichromic manner. For example, the price of a commodity and the name of a shop can be printed in different colors.

The hand labelers described herein can also be used to print the labels with specialized indicia, for example, the bar codes or the OCR characters for optical scanning systems, that especially require highly precise printing.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. An ink supply device for a hand labeler:

said labeler comprising: a labeler frame; an operating lever, which is movable with respect to said frame between two positions; a printing head, including type surfaces adapted to be inked and opposable to a platen; a platen opposable to said type surfaces; moving means for moving said printing head and said platen together and apart;

said ink supply device comprising: a support holder connected with said operating lever for being moved with respect to said frame past said type surfaces as said operating lever moves between its said positions;

an ink roller support frame; two ink rollers, arrayed generally parallel to each other and parallel to said type surfaces; a respective cartridge frame for each said ink roller; each said ink roller being rotatably supported on its respective said cartridge frame; said cartridge frames being, in turn, attached to said ink roller support frame;

retaining means connected to said ink roller support frame and extending to said support holder for retaining said ink roller support frame to said support holder; biasing means for normally urging said retaining means to extend to said support holder; said retaining means being movable in opposition to the urging by said biasing means, thereby to separate said retaining means from said support holder;

guide means comprising first guiding elements in said labeler frame and cooperating second guiding elements connected to said support holder near one of said ink rollers and being in engagement with said first guiding elements; said first guiding elements extending along said labeler frame on a first pathway past said type surfaces and on a path for guiding said one ink roller on a first path over and in engagement with and past a said type surface;

said guide means further comprising third guiding elements in said labeler frame, separate from said first guiding elements, and cooperating fourth guiding elements connected to said support holder near the second of said ink rollers, said third guiding elements extending along said labeler frame on a different second pathway past said type surfaces than said first pathway, and on a path for guiding said second ink roller on a second path over and in engagement with and past a said type surface;

one said cartridge frame being pivotally attached to said ink roller support frame, thereby to be moved between a position at which said ink rollers are generally in a plane generally parallel to said type surfaces and a position where the said ink roller on said one pivotable cartridge frame is upraised and said ink rollers are thereby no longer in a plane generally parallel to said type surfaces, thereby giving access to said one ink roller cartridge frame for removal of said ink roller from its said cartridge frame.

2. The ink supply device of claim 1, wherein said support frame comprises two spaced apart plates; means in said plates for supporting said retaining means; said retaining means comprising retaining pins positioned between said plates and projecting to said plates and to said support holder; said biasing means urging said retaining pins apart and toward said plates.

3. The ink supply device of claim 2, wherein said retaining means further comprises a respective manually engageable knob attached to each said retaining pin, said knob being engageable and pushable to move said retaining pins away from said support holder.

4. The ink supply device of claim 3, further comprising a knob retaining opening in each said plate; a respective said knob fitting into each said knob retaining opening for holding said knob in position at its respective said plate, and said plate blocking the respective said knob from passing beyond said knob retaining opening and said plate.

5. The ink supply device of claim 3, wherein said support holder comprises a respective arm outside each said support frame plate, and each said retaining pin extending through its said plate and into said support holder arm.

6. The ink supply device of claim 1, wherein said printing head is movable toward and away from said platen; said moving means comprising said operating lever being connected to said printing head for so moving it.

7. The ink supply device of claim 1, wherein each of said first and third guiding elements comprises a respective groove in said labeler frame and each of said second and fourth guiding elements comprises a respective projection from said support holder and engaging the respective said groove.

8. The ink supply device of claim 1, wherein said second and said fourth guiding elements are so shaped as to guide said support holder and said ink rollers past said type surfaces and then to swivel said support holder and said ink rollers upwardly past said printing head and out of the way of the coming together of said print head and said platen.

9. The ink supply device of claim 1, wherein said support frame comprises two spaced apart plates; means in said plates for supporting said retaining means; said retaining means comprising retaining pins positioned between said plates and projecting to said plates and to said support holder; said biasing means urging said retaining pins apart and toward said plates.

10. The ink supply device of claim 9, wherein said retaining means further comprises a respective manually engageable knob attached to each said retaining pin, said knob being engageable and pushable to move said retaining pins away from said support holder;

a knob retaining opening in each said plate; a respective said knob fitting into each said knob retaining opening for holding said knob in position at its respective said plate, and said plate blocking the respective said knob from passing beyond said knob retaining opening and said plate.

11. An ink supply device for a hand labeler:

said labeler comprising: a labeler frame; an operating lever, which is movable between two positions; a printing head, including type surfaces adapted to be inked and opposable to a platen; a platen opposable to said type surfaces; moving means for moving said printing head and said platen together and apart;

said ink supply device comprising: a support holder connected with said operating lever for being moved past said type surfaces as said operating lever moves between its said positions;

an ink roller support frame; two ink rollers, arrayed generally parallel to each other and parallel to said type surfaces; an individual support for each said ink roller and to which said ink roller is pivotally supported; each said ink roller support being supported on said ink roller support frame and at least one said ink roller support being pivotally supported on said ink roller support frame, whereby the respective said ink roller, through its said pivotable support, may pivot with respect to said support frame, thereby to maintain effective inking contact with said type surfaces as said ink rollers move over said type surfaces;

retaining means connected to said ink roller support frame and extending to said support holder for retaining said support frame to said support holder; biasing means for normally urging said retaining means to extend to said support holder; said retaining means being movable in opposition to the urging by said biasing means, thereby to separate said retaining means from said support holder;

guide means comprising first guiding elements in said labeler frame and cooperating second guiding elements connected to said support holder near one of said ink rollers and being in engagement with said first guiding elements; said first guiding elements extending along said labeler frame on a first pathway past said type surfaces and on a path for guiding said one ink roller on a first path over and in engagement with and past a said type surface;

said guide means further comprising third guiding elements in said labeler frame, separate from said first guiding elements, and cooperating fourth guiding elements connected to said support holder near the second of said ink rollers, said third guiding elements extending along said labeler frame on a different second pathway past said type surfaces than said first pathway, and on a path for guiding said second ink roller on a second path over and in engagement with and past a said type surface.

12. An ink supply device for a hand labeler:

said labeler comprising: an operating lever, which is movable between two positions; a printing head, including type surfaces adapted to be inked and opposable to a platen; a platen opposable to said type surfaces; moving means for moving said printing head and said platen together and apart;

said ink supply device comprising: a support holder connected with said operating lever for being moved past said type surfaces as said operating lever moves between its said positions;

guide means connected with said support holder for guiding said ink supply device to move along a pathway across and past said type surfaces;

an ink roller support frame; an ink roller rotatably supported on said support frame;

retaining means connected to said support frame and extending to said support holder for retaining said support frame to said support holder; biasing means for normally urging said retaining means to extend to said support holder; said retaining means being movable in opposition to the urging by said biasing means, thereby to separate said retaining means from said support holder;

said support frame being positioned on and inside said support holder, whereby said support frame and said support holder move together; a respective groove in one of said support holder and said second cartridge frame and a respective projection from the other of said holder and said second cartridge frame for extending into the said groove, thereby providing engagement between the said second cartridge frame and said support holder which prevents pivoting of said second cartridge frame with respect to said support holder and said support frame.

* * * * *